US008051914B2

(12) United States Patent
Freyer

(10) Patent No.: US 8,051,914 B2
(45) Date of Patent: Nov. 8, 2011

(54) WELL PACKING

(75) Inventor: Jan Freyer, Hafrsfjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/847,609

(22) Filed: Jul. 30, 2010

(65) Prior Publication Data

US 2010/0288514 A1 Nov. 18, 2010

Related U.S. Application Data

(63) Continuation of application No. 12/323,237, filed on Nov. 25, 2008, now Pat. No. 7,832,491, which is a continuation of application No. 11/551,143, filed on Oct. 19, 2006, now Pat. No. 7,472,757, which is a continuation of application No. 10/380,100, filed as application No. PCT/NO01/00275 on Jun. 29, 2001, now Pat. No. 7,143,832.

(30) Foreign Application Priority Data

Sep. 8, 2000 (NO) ..... 20004509

(51) Int. Cl.
*E21B 33/12* (2006.01)

(52) U.S. Cl. ..... 166/387; 166/179

(58) Field of Classification Search ..... 166/387, 166/179

See application file for complete search history.

(56) References Cited

U.S. PATENT DOCUMENTS 1,502,372 A * 7/1924 Callanan, Jr. ..... 277/341
2,002,122 A * 5/1935 McWane et al. ..... 164/111
2,144,026 A 1/1939 Park
2,849,070 A 8/1958 Maly
2,945,541 A 7/1960 Maly et al.
3,026,223 A * 3/1962 Gessler et al. ..... 138/141
3,099,318 A 7/1963 Miller et al.
3,195,907 A * 7/1965 Eckenrod ..... 277/336
3,385,367 A 5/1968 Kollsman
3,916,999 A 11/1975 Ellis et al.
3,918,523 A 11/1975 Stuber
4,137,970 A 2/1979 Laflin et al.
4,182,677 A 1/1980 Bocard et al.
4,240,800 A 12/1980 Fischer (Continued)

FOREIGN PATENT DOCUMENTS

JP 4-363499 A 12/1992

(Continued)

OTHER PUBLICATIONS

International Search Report issued Nov. 13, 2001, for International Patent Application Serial No. PCT/ NO01/00275, 3 pages.

(Continued)

*Primary Examiner* — Kenneth L Thompson
(74) *Attorney, Agent, or Firm* — Marlin R. Smith

(57) ABSTRACT

Annular packer (2) arranged on the outside of a production tubing (4) said packer comprises a core (12) comprising elastic polymer swelling by absorption of hydrocarbons. The core (12) may be surrounded by an external mantle of rubber (10), which is permeable to hydrocarbons and may be equipped with a reinforcement (11). The core (12) swells by absorption of hydrocarbons and the packer (2) expands thus in order to seal the annular space (5) between the production tubing (4) and the well wall (6).

41 Claims, 2 Drawing Sheets

U.S. PATENT DOCUMENTS

| | | | | |
|---|---|---|---|---|
| 4,558,875 | A | 12/1985 | Yamaji et al. | |
| 4,633,950 | A | 1/1987 | Delhommer et al. | |
| 4,635,726 | A | 1/1987 | Walker | |
| 4,862,967 | A | 9/1989 | Harris | |
| 5,180,704 | A | 1/1993 | Reindl et al. | |
| 5,523,357 | A | 6/1996 | Peterson | |
| 6,834,725 | B2 | 12/2004 | Whanger et al. | |
| 6,848,505 | B2 | 2/2005 | Richard et al. | |
| 7,059,415 | B2 | 6/2006 | Bosma et al. | |
| 7,143,832 | B2 * | 12/2006 | Freyer | 166/387 |
| 7,228,915 | B2 | 6/2007 | Thomson | |
| 7,472,757 | B2 * | 1/2009 | Freyer | 166/387 |
| 7,832,491 | B2 * | 11/2010 | Freyer | 166/387 |
| 2005/0199401 | A1 | 9/2005 | Patel et al. | |

FOREIGN PATENT DOCUMENTS

| | | | |
|---|---|---|---|
| JP | 09-151686 | A | 6/1997 |
| JP | 2000-064764 | A | 2/2000 |

OTHER PUBLICATIONS

European Patent Office Communication of a Notice of Opposition issued Dec. 14, 2007, for European Patent Application Serial No. 01958642.9, 16 pages.

Kirk-Othmer, Encyclopedia of Chemical Technology, 1993, vol. 6, title page, index page, and p. 70.

The Concise Oxford Dictionary, 7th ed., 1985, title page and pp. 148-149, 360-361 and 740-741.

EPO Communication issued Feb. 8, 2007: Letter from the Opponent dated Jan. 31, 2007, for European Patent Application Serial No. 01958642.9, 2 pages.

Halliburton Amendment dated Jul. 18, 2007, to EPO in response to Notice of Opposition to European Patent Application Serial No. 01958642.9, 15 pages.

EPO Communication issued Sep. 3, 2007: Letter from the Opponent dated Aug. 22, 2007, for European Patent Application Serial No. 01958642.9, 11 pages.

* cited by examiner

WELL PACKING

CROSS-REFERENCE TO RELATED APPLICATIONS

This application is a continuation of prior application Ser. No. 12/323,237 filed on 25 Nov. 2008, which is a continuation of U.S. application Ser. No. 11/551,143 filed on 19 Oct. 2006, now U.S. Pat. No. 7,472,757, which is a continuation of U.S. application Ser. No. 10/380,100 filed on 15 May 2003, now U.S. Pat. No. 7,143,832, which is a national stage filing under 35 USC 371 of international application no. PCT/N001/00275 filed on 29 Jun. 2001, which claims priority to Norway application serial no. 20004509 filed on 8 Sep. 2000. The entire disclosures of these prior applications are incorporated herein by this reference.

FIELD OF THE INVENTION

The present invention relates to a method of the nature as stated in the introduction of claim 1 for sealing of an annular space between a well wall in a production well for hydrocarbons and a production tubing, to a peripheral annular packer of the nature as stated in the claims 2-10, comprising an expandable element mainly consisting of rubber material, and to the expanding annular packer for application in said method

BACKGROUND OF THE INVENTION

Completion of oil wells with sand control screens in open hole is a simple and reliable method by to complete a reservoir section. An oil well normally penetrates formations with varying production features, which, in spite of the fact that the sand control screens are closed on the inside, may cause that undesired well fluid by-passes on the outside of these and flow into the section. Therefore, it may be desired to control or shut off sections, which do not produce desired well fluid. This necessitates sealing the external annulus.

Today such seal is achieved by application of inflatable, open-hole packers (external casing packers), which are pressurised by injecting a fluid, which is confined by means of a valve system. As soon as the packer is pressurised, it is unable to follow movements in the face of the formation. Further it is sensitive to changes in temperature and pressure, and there are often considerable problems to achieve a complete seal. Another disadvantage is that the installation of the packer is expensive since well operations requiring complicated equipment are requisited.

From U.S. Pat. No. 4,137,970 a packer is known with an element which by a chemical swelling process result in expansion of the element upon contact with water present in the well at the moment the packer is introduced to the bore hole. The packer element is employed in mining, where water is to be drained from an aquiferous layer above a clay layer. The sealing consists of an expanding packer element. During such a swelling process the packer element will initially expand fast, before it expands slower. This is impractical in an oil well, since the packer will expand before it is placed in the final operating position in the well. This implies that the packer may be put in the wrong position in the well, if it was to be employed in an application like the present invention and cause that the completion string can not be inserted to its planned final position. Application of a medium swelling in water will cause the element to expand upon contact with all regular applied completion fluids or drilling fluids.

From U.S. Pat. No. 4,633,950 polymer particles are known suspended in a special water based carrier fluid, which by circulation pumping shall be injected into a lost circulation zone. The patent does not relate to a packer element, but to a dispersion which shall trickle into porous/fractured rock. The features of such a dispersion implies that it can not be held in place in order to form a solid plug in the annular space of the well. Further, the particles will upon contact with hydrocarbons expand very rapidly due to the large surface area of the small particles. Only minor impurities of remaining oil in the system will therefore result in an undesired early expansion. Moreover, the particles in such a system will not expand at all if they do not contact hydrocarbons before the well is flowing back. This may lead to the polymer being produced with the produced fluids.

Most rubbers have a larger absorption capacity and faster swelling in an aromatic and/or naphtenic hydrocarbon than in an aliphatic hydrocarbon. Most rubbers also have considerably less swelling in water based fluid than in an oil based fluid.

Generally base-oils used in drilling fluids have a higher portion of aliphatic (80-100%) constituents than produced hydrocarbons, normally having 35-80% aliphatic constituents. This implies that most rubbers will have a larger and faster expansion in produced hydrocarbons than in drilling fluids.

PURPOSE OF THE INVENTION

The purpose of the present invention is to enable completion of reservoir sections by complete annular seal, at the same time as the invention allows variations in operational parameters and geological conditions without changing the functionality of the invention. The packer will expand less while the packer is inserted into the well in a drilling fluid or completing fluid than by exposure to hydrocarbons produced from the formation.

This is achieved by the present method for sealing of an annular space between a well wall in a production well for hydrocarbons and a production tubing with a peripheral annular packer comprising an expandable element mainly consisting of rubber material characterised in that in said element a rubber is used which expands by absorbing hydrocarbons, and that the annular packer is inserted mainly by exposing the expanding element to hydrocarbons included in the product of the well.

Further the invention provides an expanding annular packer for use in the method for sealing of the annular space, comprising an expanding element consisting mainly of rubber material which is characterised in that the expanding element is directed to expanding mainly by absorbing hydrocarbons produced by the underground formation.

Further features of the invention are given in the claims 3-10.

SHORT DESCRIPTION OF THE FIGURES

Figure 1:
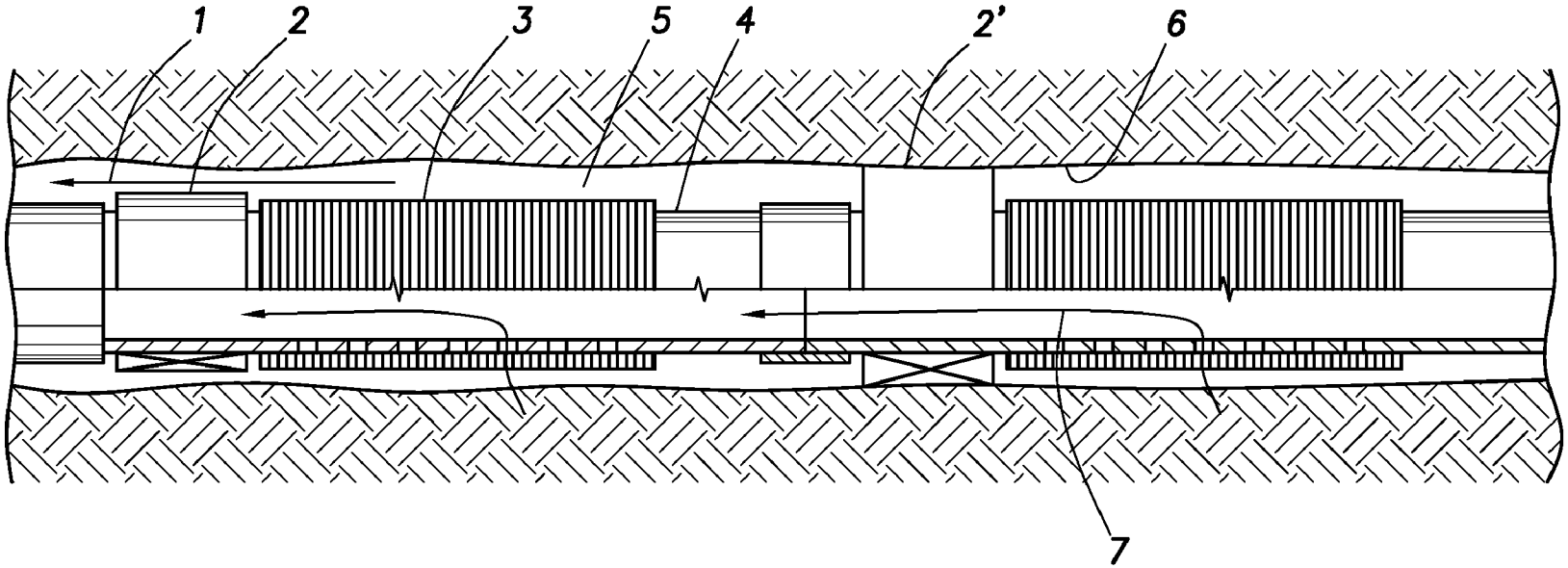
FIG. 1 is a longitudinal section through an area of a production well illustrating the present invention.
Figure 2:
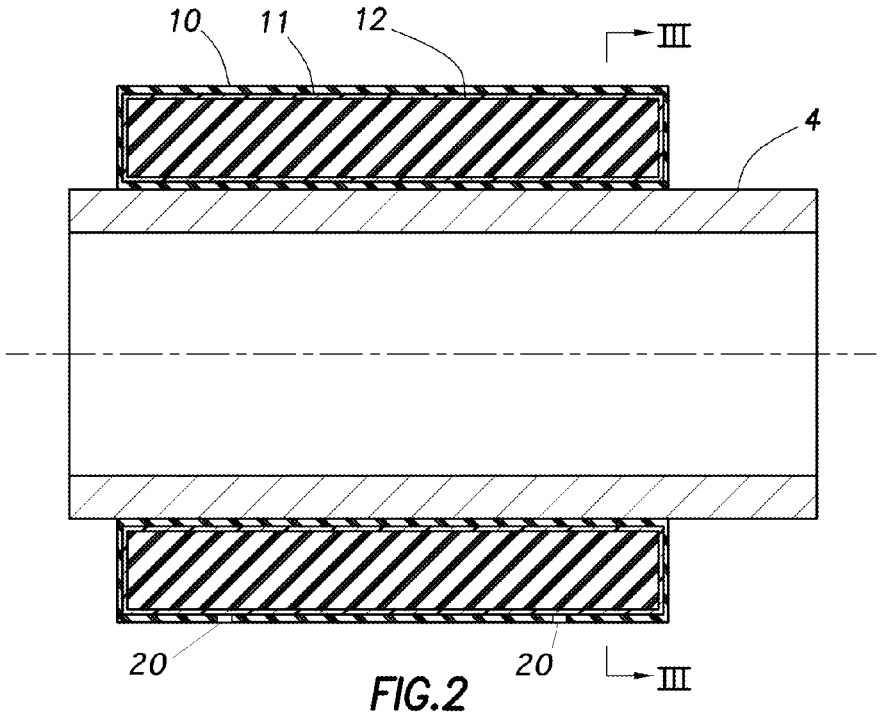
FIG. 2 is a longitudinal section of a production tubing with an annular packer according to the present invention.
Figure 3:
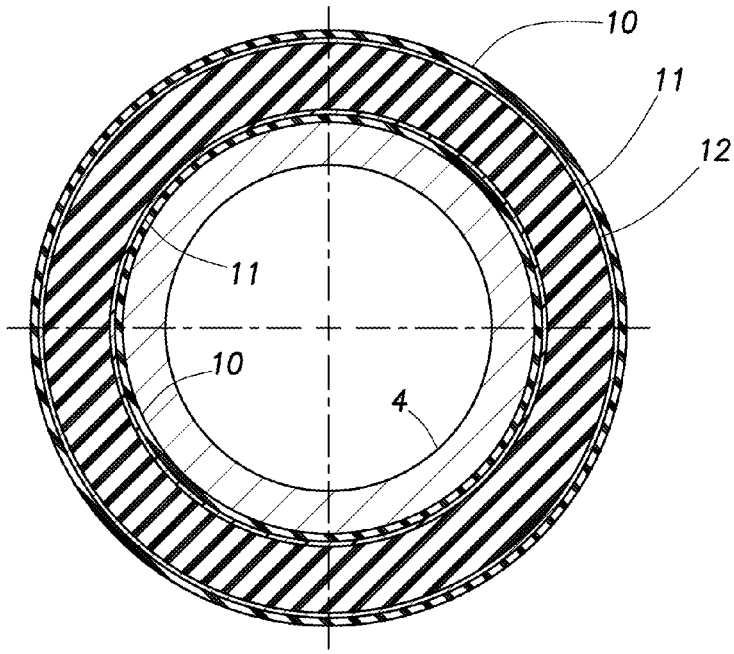
FIG. 3 is a section along the line in FIG. 2.

In the following, the invention is further described. The permanent annular packer 2 for use in hydrocarbon production wells, preferably oil production wells, is placed on the outside of a pipe 4, said packer expands by the core 12 swelling upon exposure for and absorption of hydrocarbons.

The packer therefore seals the annular space 5 towards the well wall 6. The production well may be an open-hole well or a well with a casing, which is characterised in that the production tubing 4 is drawn in an open hole or that the production tubing 4 is drawn in a casing (not shown), respectively. Thus the annular space 5 consists of the external surface of the production tubing 4 and the bore hole wall, or the external surface of the production tubing 4 and the internal surface in the casing, respectively.

An oil stream 1 flows past a packer element 2 before the packer element 2 is expanded and sealing towards the well wall 6. A sand control filter 3 is attached to a production tubing 4. A packer element 2' is expanded and sealing towards the well wall 6 so that a well fluid 7 can not bypass the packer element in the annular space 5.

An external, protecting mantle 10 equipped with a reinforcement 11 surrounds a core 12 comprising elastic polymer, said coating works as a permeable membrane. The external mantle 10 comprises a rubber with higher resistance and lower rate of diffusion towards hydrocarbons than the core 12. The packer element, which may consist of a mantle 10, reinforcement 11 and core 12, is placed on the outside of a tube 4.

The packer 2 consists of a core 12 comprising an elastic polymer, e.g. EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber or polynorbornene, said core is swelling in contact with and by absorption of hydrocarbons so that the packer expands. The rubber of the core may also have other materials dissolved or in mechanical mixture, such as fibres of cellulose processed as described in U.S. Pat. No. 4,240,800. Additional options may be rubber in mechanical mixture with polyvinyl chloride, methyl methacrylate, acrylonitrile, ethylacetate or other polymers expanding by contact with oil.

An external, reinforced mantle 10 protects the core towards direct exposure to drilling fluid and hydrocarbons. At the same time the mantle 10 allows migration of hydrocarbons to the core 12 and swelling (and thus expanding of the packer). The external, reinforced mantle 10 comprises rubber, for example acrylonitrile, hydrogenated nitrile, chloroprene, ethylene vinylacetate rubber, silicone, ethylene propylene diene monomer, butyl, chlorosulphonated polyethylene, polyurethane, ACM, BIMS or other types of rubber having less expansion or slower diffusion than the core and a reinforcement 11, preferably fibre reinforcement, e.g. kevlar, said reinforcement reinforces the external mantle 10. An essential feature of the rubber in the mantle 10 is that it has a swelling in drilling fluids, which is slower than the core 12. With "a higher resistance towards hydrocarbons" is here meant that the rubber only to a small degree swells upon exposure to hydrocarbons.

Several elastic polymers have a considerable absorption of hydrocarbons without absorption of water, and the polymers in the present invention are predominantly hydrophobic. By immersion in a hydrocarbonaceous medium, hydrocarbons migrate into and through the external mantle 10 and further into the core 12, which is swelling upon absorption of these.

The present invention provides several benefits compared to state of the art. The packer adjusts continuously to variations in the movements of the formation or washouts of the borehole, which implies that better shutting off/sealing between reservoir sections may be achieved and undesired well fluid can not flow past the packer element in the annular space. There is no need for well operations when installing the packer, which represents cost savings compared to today's methods for installation. The packer has no moving parts and is thus a simple and reliable device. The packer expands faster and more in a produced hydrocarbon, than in a water based or oil based drilling fluid or completion fluid at the same temperature and will thus expand less when the packer is immersed in drilling fluid.

In another embodiment of the present invention, the core 12 is surrounded by an external mantle of rubber, e.g. a nitrile which is not reinforced.

In further another embodiment of the present invention, the core 12 is surrounded by an outer web which may be the reinforcement.

In a further embodiment of the present invention the core 12 is surrounded by an external mantle of rubber, e.g. a nitrile, said mantle in itself does not let hydrocarbons penetrate, but a small part 11 of the core 12 is exposed directly to hydrocarbons through openings in the outer coating.

In an even further embodiment of the present invention the core 12 is not surrounded by an external mantle, but is exposed directly to hydrocarbons. In this aspect, the core 12 has a composition comprising elastic polymer with sufficient features to fulfil the desired functions of the packers.

What is claimed is:

1. An annular packer for use in a subterranean well, the packer comprising:

a reinforcement; and swellable material positioned both internal and external to the reinforcement, wherein the packer seals an annular space in response to swelling of the swellable material, and wherein the swellable material swells in response to contact with a fluid.

2. The packer of claim 1, wherein the reinforcement is generally cylindrical-shaped.

3. The packer of claim 1, wherein the reinforcement and the swellable material are positioned external to a pipe.

4. The packer of claim 1, wherein at least a first portion of the swellable material is positioned radially between the reinforcement and the pipe, and wherein at least a second portion of the swellable material is positioned external to the reinforcement.

5. The packer of claim 4, wherein the swellable material in the first portion swells a greater amount as compared to the swellable material in the second portion in response to contact with the fluid.

6. The packer of claim 5, wherein at least a third portion of the swellable material is positioned radially between the first portion and the pipe.

7. The packer of claim 6, wherein the swellable material in the first portion swells a greater amount as compared to the swellable material in the third portion in response to contact with the fluid.

8. The packer of claim 4, wherein the swellable material in the second portion swells a greater amount as compared to the swellable material in the first portion in response to contact with the fluid.

9. The packer of claim 8, wherein at least a third portion of the swellable material is positioned radially outward of the second portion.

10. The packer of claim 9, wherein the swellable material in the second portion swells a greater amount as compared to the swellable material in the third portion in response to contact with the fluid.

11. The packer of claim 4, wherein the swellable material in the first portion swells at a greater rate as compared to the swellable material in the second portion in response to contact with the fluid.

12. The packer of claim 11, wherein at least a third portion of the swellable material is positioned radially between the first portion and the pipe.

13. The packer of claim 12, wherein the swellable material in the first portion swells at a greater rate as compared to the swellable material in the third portion in response to contact with the fluid.

14. The packer of claim 4, wherein the swellable material in the second portion swells at a greater rate as compared to the swellable material in the first portion in response to contact with the fluid.

15. The packer of claim 14, wherein at least a third portion of the swellable material is positioned radially outward of the second portion.

16. The packer of claim 15, wherein the swellable material in the second portion swells at a greater rate as compared to the swellable material in the third portion in response to contact with the fluid.

17. The packer of claim 4, wherein the fluid diffuses through the swellable material in the first portion at a greater rate as compared to the swellable material in the second portion.

18. The packer of claim 17, wherein at least a third portion of the swellable material is positioned radially between the first portion and the pipe.

19. The packer of claim 18, wherein the fluid diffuses through the swellable material in the first portion at a greater rate as compared to the swellable material in the third portion.

20. The packer of claim 4, wherein the fluid diffuses through the swellable material in the second portion at a greater rate as compared to the swellable material in the first portion.

21. The packer of claim 20, wherein at least a third portion of the swellable material is positioned radially outward of the second portion.

22. The packer of claim 21, wherein the fluid diffuses through the swellable material in the second portion at a greater rate as compared to the swellable material in the third portion.

23. The packer of claim 1, wherein the reinforcement comprises a fiber reinforcement.

24. The packer of claim 1, wherein the reinforcement comprises a Kevlar material.

25. An annular packer for use in a subterranean well, the packer comprising:

at least one generally cylindrical-shaped reinforcement;

at least one annular first portion of swellable material positioned external to the reinforcement;

at least one annular second portion of swellable material positioned internal to the reinforcement; and the reinforcement and the first and second portions of swellable material being disposed on a pipe, wherein the packer seals an annular space in response to swelling of the first and second portions of swellable material, and wherein the swellable material swells in response to contact with a fluid.

26. The packer of claim 25, wherein the swellable material in the first portion swells a greater amount as compared to the swellable material in the second portion in response to contact with the fluid.

27. The packer of claim 25, wherein the swellable material in the second portion swells a greater amount as compared to the swellable material in the first portion in response to contact with the fluid.

28. The packer of claim 25, wherein the swellable material in the first portion swells at a greater rate as compared to the swellable material in the second portion in response to contact with the fluid.

29. The packer of claim 25, wherein the swellable material in the second portion swells at a greater rate as compared to the swellable material in the first portion in response to contact with the fluid.

30. The packer of claim 25, wherein the fluid diffuses through the swellable material in the first portion at a greater rate as compared to the swellable material in the second portion.

31. The packer of claim 25, wherein the fluid diffuses through the swellable material in the second portion at a greater rate as compared to the swellable material in the first portion.

32. The packer of claim 25, wherein the reinforcement comprises a fiber reinforcement.

33. The packer of claim 25, wherein the reinforcement comprises a Kevlar material.

34. The packer of claim 25, further comprising at least one annular third portion of swellable material positioned radially between the second portion and the pipe.

35. The packer of claim 34, wherein the swellable material in the third portion swells a lesser amount as compared to the swellable material in at least one of the first and second portions in response to contact with the fluid.

36. The packer of claim 34, wherein the swellable material in the third portion swells at a lesser rate as compared to the swellable material in at least one of the first and second portions in response to contact with the fluid.

37. The packer of claim 34, wherein the fluid diffuses through the swellable material in the third portion at a lesser rate as compared to the swellable material in at least one of the first and second portions.

38. The packer of claim 25, further comprising at least one annular third portion of swellable material positioned radially outward relative to the first portion.

39. The packer of claim 38, wherein the swellable material in the third portion swells a lesser amount as compared to the swellable material in at least one of the first and second portions in response to contact with the fluid.

40. The packer of claim 38, wherein the swellable material in the third portion swells at a lesser rate as compared to the swellable material in at least one of the first and second portions in response to contact with the fluid.

41. The packer of claim 38, wherein the fluid diffuses through the swellable material in the third portion at a lesser rate as compared to the swellable material in at least one of the first and second portions.

* * * * *